US005353443A

United States Patent [19]

Sim

[11] Patent Number: 5,353,443

[45] Date of Patent: Oct. 11, 1994

[54] TOILET ASSEMBLY HAVING A COMBINED AUTOMATIC VENTILATION AND FLUSHING SYSTEM

[76] Inventor: Jae K. Sim, 5021 Crescent Dr., Anaheim, Calif. 92807

[21] Appl. No.: 95,003

[22] Filed: Jul. 23, 1993

[51] Int. Cl.[5] ..... E03D 9/04

[52] U.S. Cl. ..... 4/216

[58] Field of Search ..... 4/213, 216, 217

[56] References Cited

U.S. PATENT DOCUMENTS 5,005,222 4/1991 Sim ..... 4/216
5,054,131 10/1991 Sim ..... 4/216
5,079,782 1/1992 Sim ..... 4/216
5,167,039 12/1992 Sim ..... 4/216

*Primary Examiner*—Charles E. Phillips
*Attorney, Agent, or Firm*—Birch, Stewart, Kolasch & Birch

[57] ABSTRACT

A toilet assembly having a combined automatic ventilation and flushing system, which comprises a returnable solenoid member, a trap way, a trap way valve member, a multifunctional tube member, and a motion sensor whereby while the user sits on the toilet seat ring, the objectionable odor is effectively ventilated and when the user stands up, the toilet assembly is automatically flushed.

18 Claims, 5 Drawing Sheets

Fig. 6A
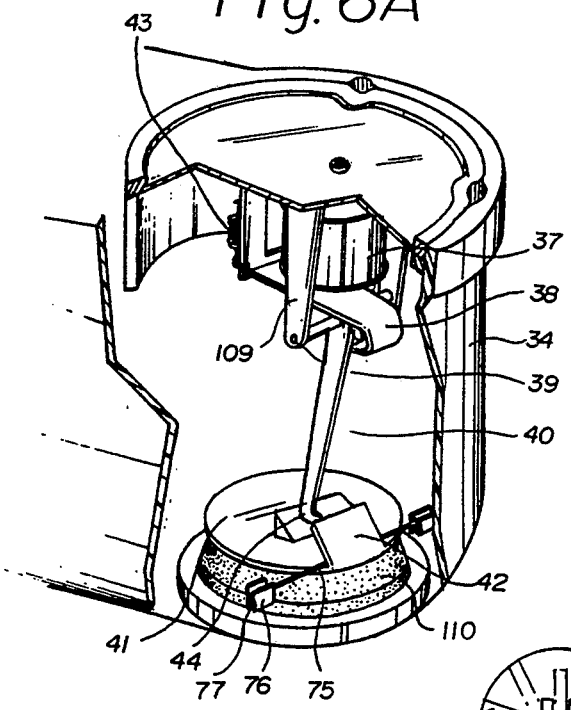
Fig. 6B
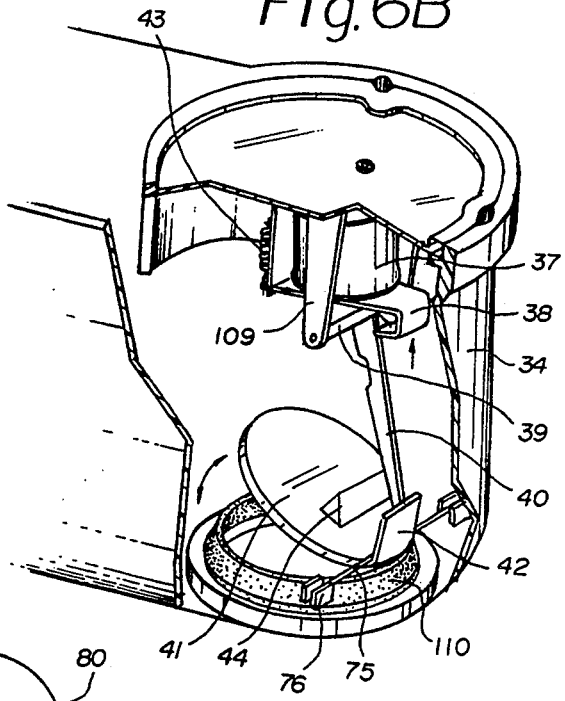
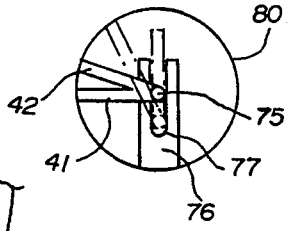
Fig. 6C
Fig. 7A
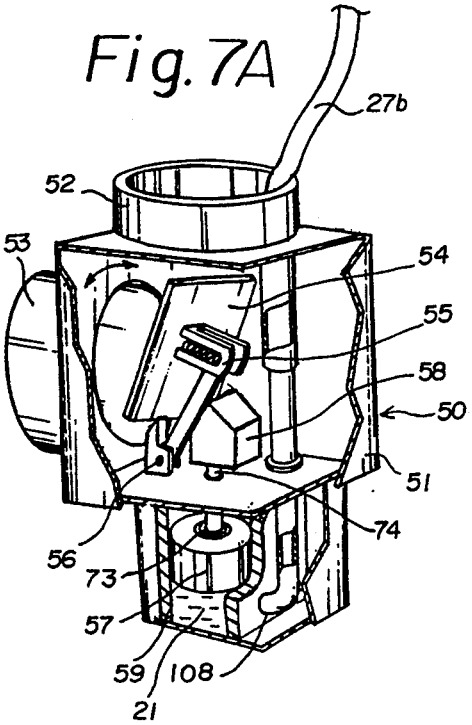
Fig. 7B
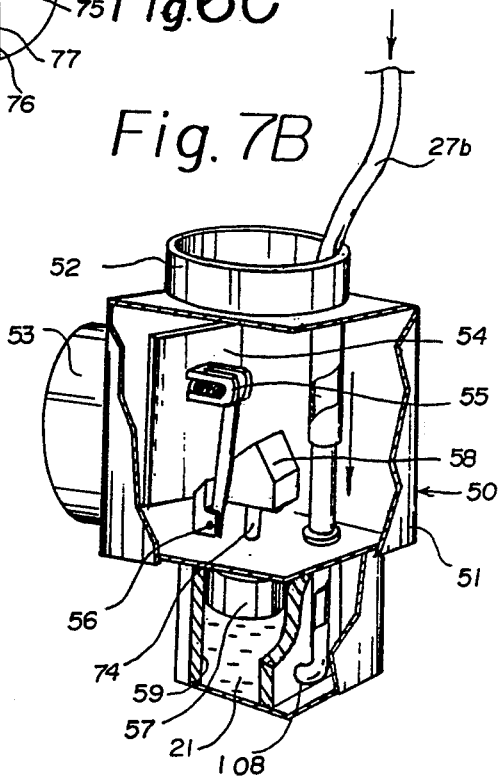

TOILET ASSEMBLY HAVING A COMBINED AUTOMATIC VENTILATION AND FLUSHING SYSTEM

BACKGROUND OF THE INVENTION

1. Field of the Invention

The present invention relates to a toilet assembly having a combined automatic ventilation and flushing system and more particularly, a toilet assembly including a returnable solenoid member, a trap way, a trap way valve member, a multifunctional tube member, and a motion sensor whereby while the user sits on a seat ring, any objectionable odor is ventilated and when the user stands up, the toilet assembly is automatically flushed.

2. Description of Related Art

Various types of non-siphon type ventilating toilets are generally known in the art to be utilized with a fan for ventilating contaminated air through a separate exhaust duct. Several types of non-siphon type ventilating toilets are known in the art as a European type toilet to be utilized with a gas exhaust conduit disposed adjacent to a toilet stool and connected to a sewer discharge line and a fan/motor connected to an on/off switch of a light of the toilet.

However, these toilets suffer from a number of problems such as, for example, (1) the waste product and associated objectionable odor does not clearly discharge directly to the sewer discharge line since the ventilating conduit is directly connected to the sewer discharge line, (2) these conventional toilets are very complicated in structure, expensive to manufacture, and difficult to use, (3) since the flush water can flow into the ventilating conduit, the amount of water and the water pressure of the flush water are minimized so that these toilets cannot effectively achieve the flushing purpose thereof, and (4) since such toilets are utilized with relay type or an on/off switch for activation of the fan, this switch may be out of order frequently. Furthermore, such toilets may not employ the use of a water overflowing system and even if the system were used, it may be very complicated in structure and inefficient in use.

Such toilets are described in Baither, U.S. Pat. No. 2,227,920; Baither, U.S. Pat. No. 2,297,935; Sanford, U.S. Pat. No. 2,329,221; Fitzgerald, U.S. Pat. No. 2,443,705; Wilson, U.S. Pat. No. 2,575,778; Fitzgerald, U.S. Pat. No. 2,817,099; Shay, U.S. Pat. No. 2,847,682; Taggart, U.S. Pat. No. 3,495,282; Ikehata, U.S. Pat. No. 3,805,304; Baker, U.S. Pat. No. 4,222,129; Beeghly et al., U.S. Pat. No. 4,232,406; Williams et al., U.S. Pat. No. 4,318,192; Sanstrom, U.S. Pat. No. 4,365,361; Drummond, U.S. Pat. No. 4,494,255; and Higgins, U.S. Pat. No. 4,865,664.

In order to avoid these problems, U.S. Pat. No. 5,005,222, issued to the present inventor, discloses a toilet assembly which includes a toilet stool having a ventilation conduit disposed adjacent to the back wall portion of the toilet stool wherein the ventilation conduit extends angularly around a siphon conduit at the point where they communicate with a sewer discharge line, a fan member disposed in the lower portion of the ventilation conduit, a toilet water holding tank having a motion sensor disposed on the front exterior thereof and free of interference from the opening and closing of a toilet seat cover, a multifunctional tube having a U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion sensor actuates the fan member allowing the objectionable odor to be ventilated, and in turn when the user stands up and flushes the toilet assembly, the motion sensor deactivates and simultaneously the flush water discharges the waste products and associated objectionable odor directly to the sewer discharge line.

Another U.S. Pat. No. 5,079,782 issued to the present inventor, discloses a toilet assembly which includes a toilet stool having ventilation conduit disposed adjacent to the back wall portion of the toilet stool and a gas exhaust duct connected to the ventilation conduit and having a raised portion disposed at the interior surface thereof for allowing exhaust gas to flow from a flush ring to the ventilation conduit, said raised portion being provided with a water exiting tube for preventing the flush water from the water exiting tube from flowing into the ventilation conduit, whereby the flush water discharges the waste products and associated objectionable odor directly to the sewer discharge line.

A further U.S. Pat. No. 5,054,131 issued to the present inventor, discloses a toilet assembly which includes a toilet stool having a ventilation conduit disposed adjacent to the back wall portion of the toilet stool and a U-shaped exhaust duct disposed in the toilet holding tank and connected to the ventilation conduit for allowing exhaust gas to flow from a flush ring to the ventilation conduit, whereby the flush water discharges the waste product and associated objectionable odor directly to the sewer discharge line.

Still another U.S. Pat. No. 5,167,039 issued to the present inventor, discloses a non-siphon type ventilating toilet assembly which includes a U-shaped ventilation tube disposed in the toilet holding tank for ventilating objectionable odor from the toilet bowl. The ventilation tube contains a cap valve which moves upwardly and downwardly along an outer-screwing shaft of an upper motor and a fan of a side motor. Both motors are connected to a motion sensor, whereby upon opening the toilet seat cover having a sensor aperture and sitting by the user on the seat ring, the motion sensor actuates, allowing both motors to be operated and simultaneously open the cap valve so that the objectionable odor is ventilated. In turn when the user stands up and flushes the toilet assembly, the motion sensor deactivates, allowing both motors to be stopped and simultaneously closing the cap valve and the flush water discharges the waste products to the sewer discharge line.

However, these toilet assemblies do not achieve a perfect discharge of the objectionable odor and are somewhat complicated in construction. In addition, these toilet assemblies do not disclose or suggest the use of an automatic flushing system with an automatic ventilation system.

SUMMARY OF THE INVENTION

Accordingly, it is an object of the present invention to provide an improved toilet assembly having a combined automatic ventilation and flushing system whereby objectionable odor from the toilet bowl is effectively flushed and ventilated therefrom, and discharged into a sewer discharge line, which eliminates the above problems encountered in a conventional toilet assembly.

Another object of the present invention is to provide a siphon-type toilet assembly which includes a large odor air valve and a large motor fan whereby the objectionable odor is effectively ventilated and noise of the motor fan can be readily reduced.

A further object of the present invention is to provide a toilet assembly which does not include a separate air conduit so that the ventilation of the toilet assembly of the present invention is effectively performed and is fully legal with the plumbing code.

Still another object of the present invention is to provide an improved toilet assembly which includes a motion sensor having an on/off switch function for ventilation and flushing, a returnable solenoid system for automatic flushing, an odor air valve member, a trap way, and a trap way valve, whereby upon opening the toilet seat cover, while the user sits on the seat ring, the motion sensor is actuated for triggering an electromagnet and opening the odor air valve so that the objectionable odor is ventilated, and in turn, when the user stands up, the motion sensor is actuated for flushing and enabling a closing of the odor air valve and simultaneously, the trap way valve is closed, so that the flush water discharges the waste products to the sewer discharge line.

Yet another object of the present invention is to provide a ventilation toilet assembly which further comprises a water overflow ball valve movable in a net chamber disposed at the top area of an L-shaped upward tube for allowing water to discharge thereinto upon overflowing of the flush water.

Still another object of the present invention is to provide a toilet assembly which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toilet assembly having a combined automatic ventilation and flushing system, which comprises a returnable solenoid member, a trap way, a trap way valve member, a multifunctional tube member, and a motion sensor whereby while the user sits on the toilet seat ring, the objectionable odor is effectively ventilated and when the user stands up, the toilet assembly is automatically flushed.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 6A is a perspective view of an odor air valve member containing cut-away portions in order to illustrate the construction thereof in a closed position;

FIG. 6B is a perspective view of the odor air valve member containing cut-away portions in order to illustrate the construction thereof in an open position according to the present invention;

FIG. 7A is a perspective view of the trap way valve member containing cut-away portions in order to illustrate the construction thereof in an open position according to the present invention;

FIG. 7B is a perspective view of the trap way valve member containing cut-away portions in order to illustrate the construction thereof in a closed position according to the present invention.

DESCRIPTION OF THE PREFERRED EMBODIMENTS

Figure 1:
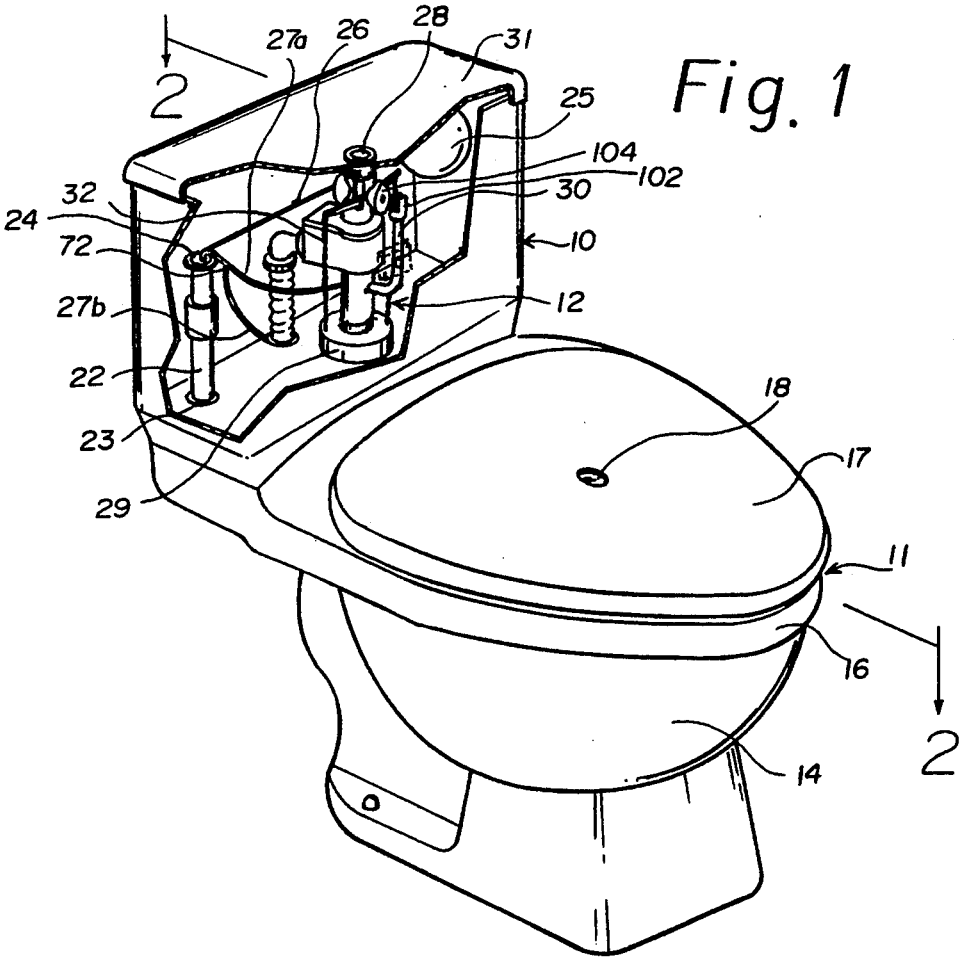
FIG. 1 is a perspective view of the toilet assembly according to the present invention containing cut-away portions in order to illustrate the construction of the toilet assembly of the present invention.
Figure 2:
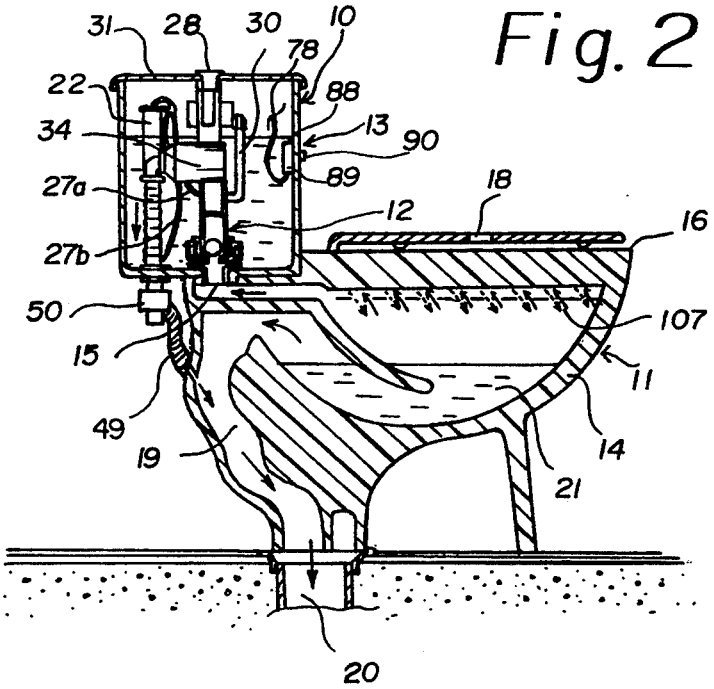
FIG. 2 is a sectional view of FIG. 1, taken along lines 2—2 of FIG. 1.

Referring now in detail to the drawings for the purpose of illustrating preferred embodiments of the present invention, the toilet assembly as shown in FIGS. 1 and 2, comprises a toilet water holding tank 10, a toilet stool 11, a multifunctional tube member 12 disposed in the toilet water holding tank 10, and a motion sensor member 13 disposed on the front exterior of the toilet water holding tank 10.

The toilet stool 11 includes a toilet bowl 14 having a main tunnel 15 disposed at the upper portion of the toilet bowl 14 for allowing fresh flush water 21 to be flushed into the toilet bowl 14 and odor air to be transported to the multifunctional tube member 12, and a seat ring 16 operatively located on the top of the toilet bowl 14. The toilet stool 11 further includes a toilet seat cover 17 having a sensor aperture 18 operatively located on the seat cover 17 with the toilet seat cover 17 being pivotally connected to the seat ring 16 by pivotal hinges (not shown). A siphon passage 19 is disposed in the toilet bowl 14 and communicates with the multifunctional tube 12 for discharging waste products and associated objectionable odor directly from the toilet bowl 14 to a sewer discharge line 20.

The toilet water holding tank 10 contains the water 21 to be flushed into the toilet bowl 14 through a main tunnel 15 of the toilet stool 11. The toilet water holding tank 10 includes a water supply tube 22 connected to a water supply line (not shown) through a water intake valve 23 disposed at the bottom end thereof and a float valve 24 disposed at the top end thereof, a float member 25 connected to the float valve 24 through a rod 26. The toilet water holding tank 10 further includes a first water hose **27*a* connected to an L-shaped upwardly oriented tube 30 for allowing the flush water 21 to fill the toilet water holding tank 10 and a second water hose 27*b* connected to a trap way valve member 50, a manual flush push button 28 disposed on the top of a toilet tank cover 31 of the toilet holding tank 10 for connection to a flapper valve button 29 and a pair of chains 32. The water supply tube 22 stands upright within the toilet holding tank 10**.

Figure 3:
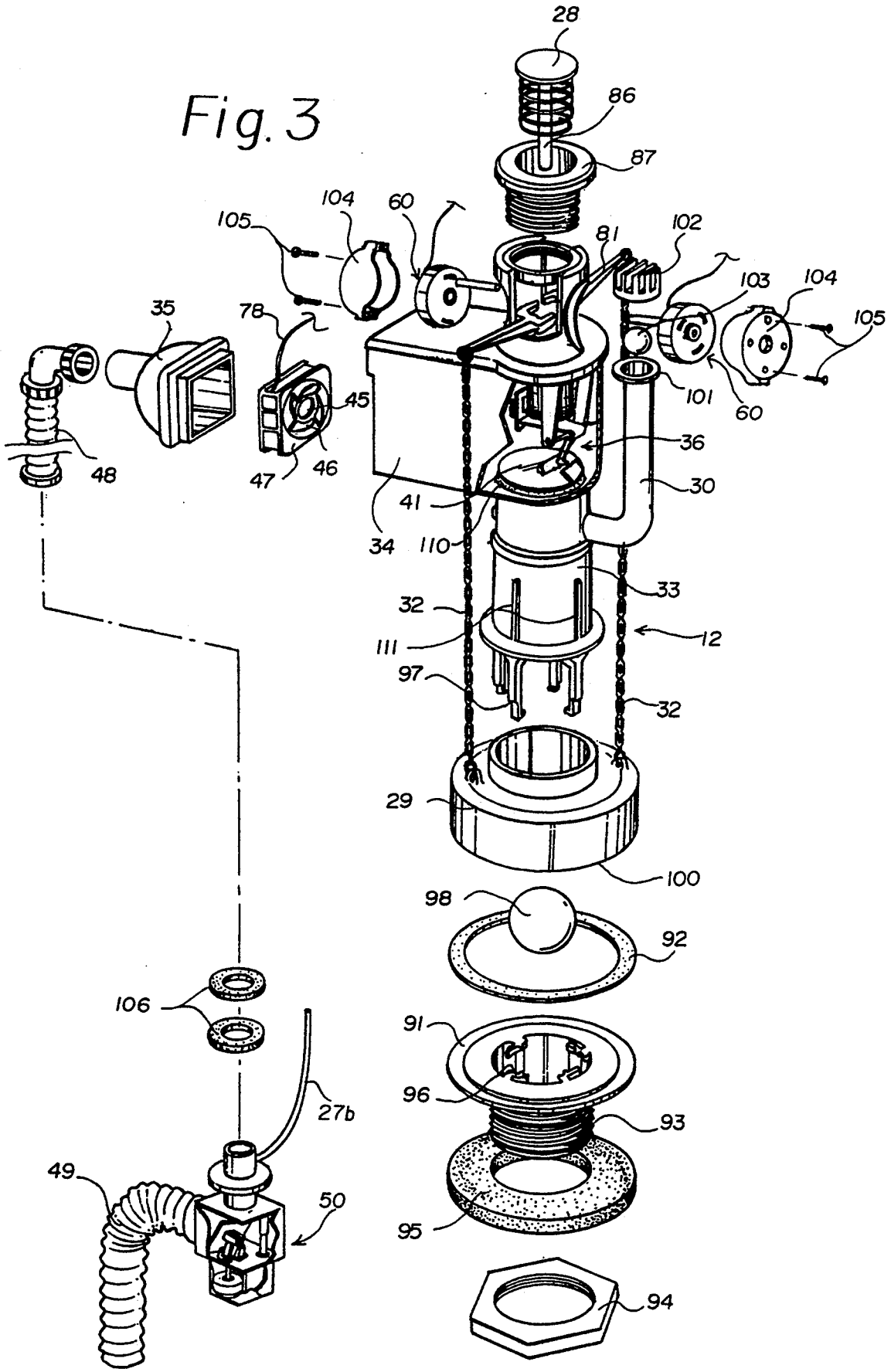
FIG. 3 is an exploded perspective view of an odor valve member disposed in the toilet water holding tank and a trap way valve member according to the present invention.
Figure 4:
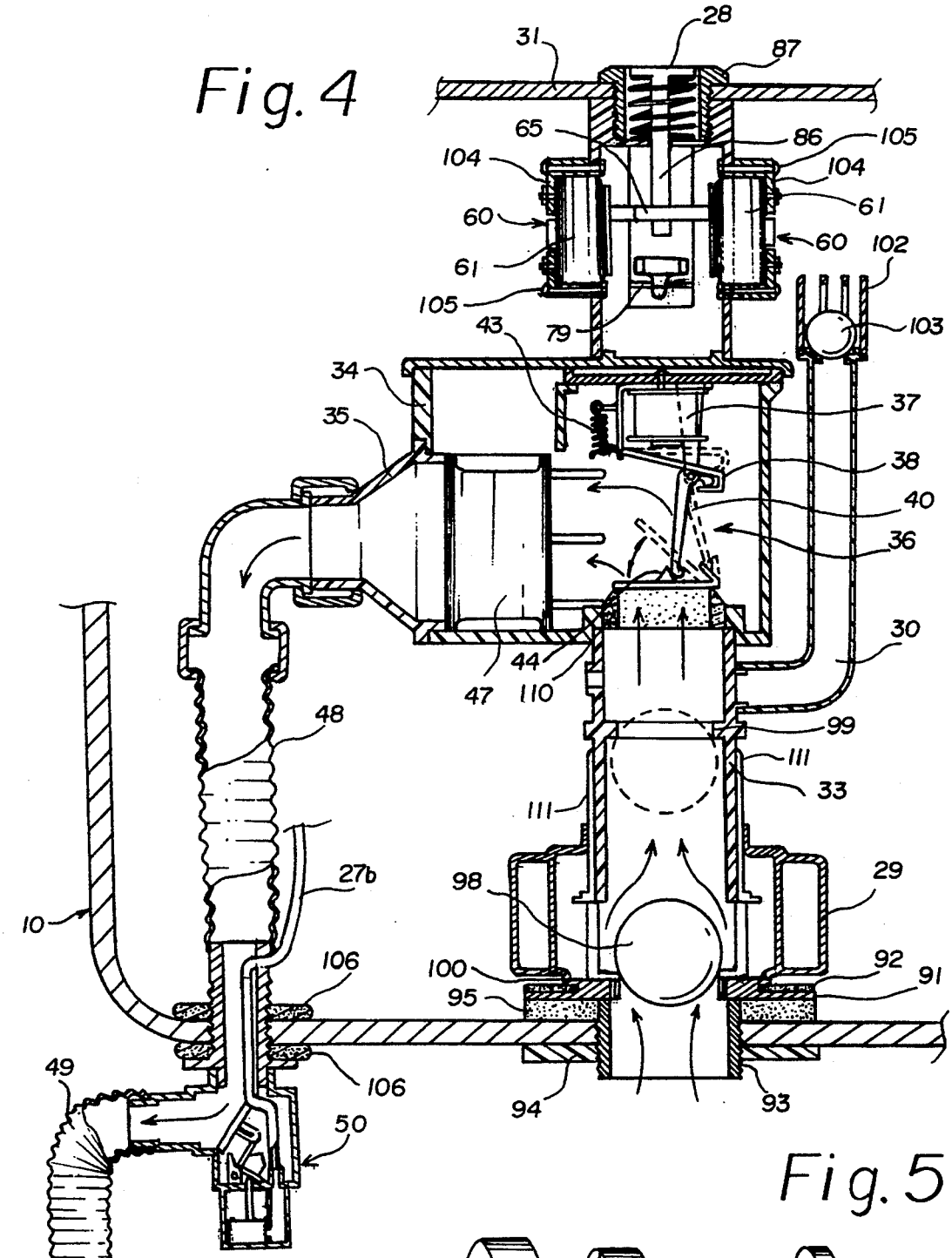
FIG. 4 is a sectional view of the multifunctional tube member and the trap way valve member according to the present invention.

As shown in FIGS. 3 and 4, the multifunctional tube member 12 includes a vertical main tube 33 supported by and depending on the bottom of the toilet water holding tank 10, a pocket 34 extending from one upper side wall of the vertical main tube 33, the L-shaped upwardly oriented tube 30 extending from the middle wall of the other side of the vertical main tube 33, and an L-shaped downward tube 35 extending from the pocket 34.

As shown in FIGS. 3 and 4, an odor air valve member 36 of the multifunctional tube member 12 includes an electromagnet 37 operatively associated with a C-shaped contacting plate 38 to be attached to the electriomagnet 37 when the electromagnet 37 is activated by the motion sensor 13. The odor air valve member also includes a lever 40 inwardly hooked at both ends, and an odor air valve plate 41 having an odor air valve handle 42 for operatively connecting with one end of the hooked lever 40 so as to open the odor air valve plate 41 (FIG. 6B). The lever 40 is easily pivoted about a first pivot pin 39 pivotally supported by a pivot pin support 109 of the odor air valve member 36.

As shown in FIG. 6A, when the electric source (not shown) with DC 12 volts is in an off-position in response to actuating a motion sensor 89 of the motion sensor member 13, the electromagnetic 37 is returned to the original position by biasing a spring 43 (FIG. 4). Therefore, the contacting plate 38 pushes the upper end portion of the hooked lever 40 down and simultaneously, the lower end portion of the lever 40 moves from the valve handle 42 and moves to the odor air valve plate 41 through a trihedron 44 whereby the odor air valve plate 41 is tightly closed against a rubber gasket top opening 110 of the vertical main tube (FIG. 4). As shown in an enlarged drawing of FIG. 6A, a hinge member 80 of the odor air valve member 36 includes a valve rod 75 attached to the connecting portion of the air valve plate 41 and air valve handle 42, a pair of rod seats 76, and a groove 77 of each rod seat 76 for movably receiving the valve rod 75 depending on opening and closing of the odor air valve plate 41.

When the motion sensor 89 is actuated, the electromagnet 37 actuates, the odor air valve plate 41 opens and simultaneously, a fan motor 45 and a fan 46 disposed within a fan motor housing 47 operates, the odorous air or exhaust gas flows to the L-shaped downward tube 35 through the vertical main tube 33. A first air tube 48 extends to a second air tube 49 through a pair of third rubber packing 106 (FIG. 3).

As shown in FIGS. 4, 7A, and 7B, the trap way valve member 50 disposed between the air tubes 48 and 49 includes an upper opening 52 and a side opening 53 for allowing the exhaust gas to pass therethrough, a trap way valve plate 54 attached to an L-shaped pivotal lever 55 by a second pivot pin 56, and a piston 57 having a pentahedron head 58 for opening and closing the trap way valve plate 54.

When the flushing starts, the fresh water 21 is supplied to the toilet water holding tank 10 through the first water hose **27*a* and is supplied to a piston housing 59 disposed in the lower portion of the trap way valve member housing 51 through a second water hose 27*b*. At this time, the piston 57 moves up in response to the water pressure. The vertical face of the pentahedron 58 pushes against the pivotal lever 55 so that the trap way valve plate 54 is tightly closed against the side opening 53 (FIG. 7B**).

However, when the water 21 is not supplied, the water pressure discharges through an air discharge opening 71 of the second water hose **27*b*. Accordingly, the piston 57 is returned to the original position, that is, moves down by the gravity thereof, and the inclined face of the pentahedron 58 supports the pivotal lever 55. Therefore, the trap way valve plate 54 is opened at an angle of about 45° and the exhaust gas can pass through the trap way valve member 50 (FIG. 7A). Since the air discharge opening 72 disposed on the upper end portion of the second water hose 27*b* is located over the water surface of the toilet water holding tank 10, when the flushing finishes, the air pressure in the second water hose 27*b*** is easily discharged.

Figure 5:
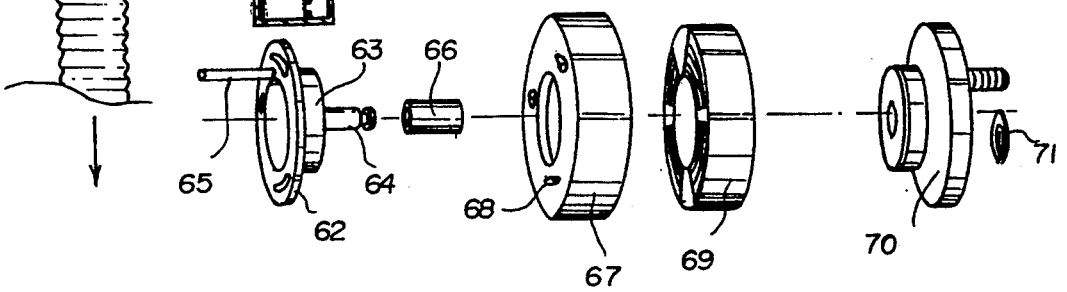
FIG. 5 is an exploded perspective view of a returnable solenoid member according to the present invention.
Figure 8:
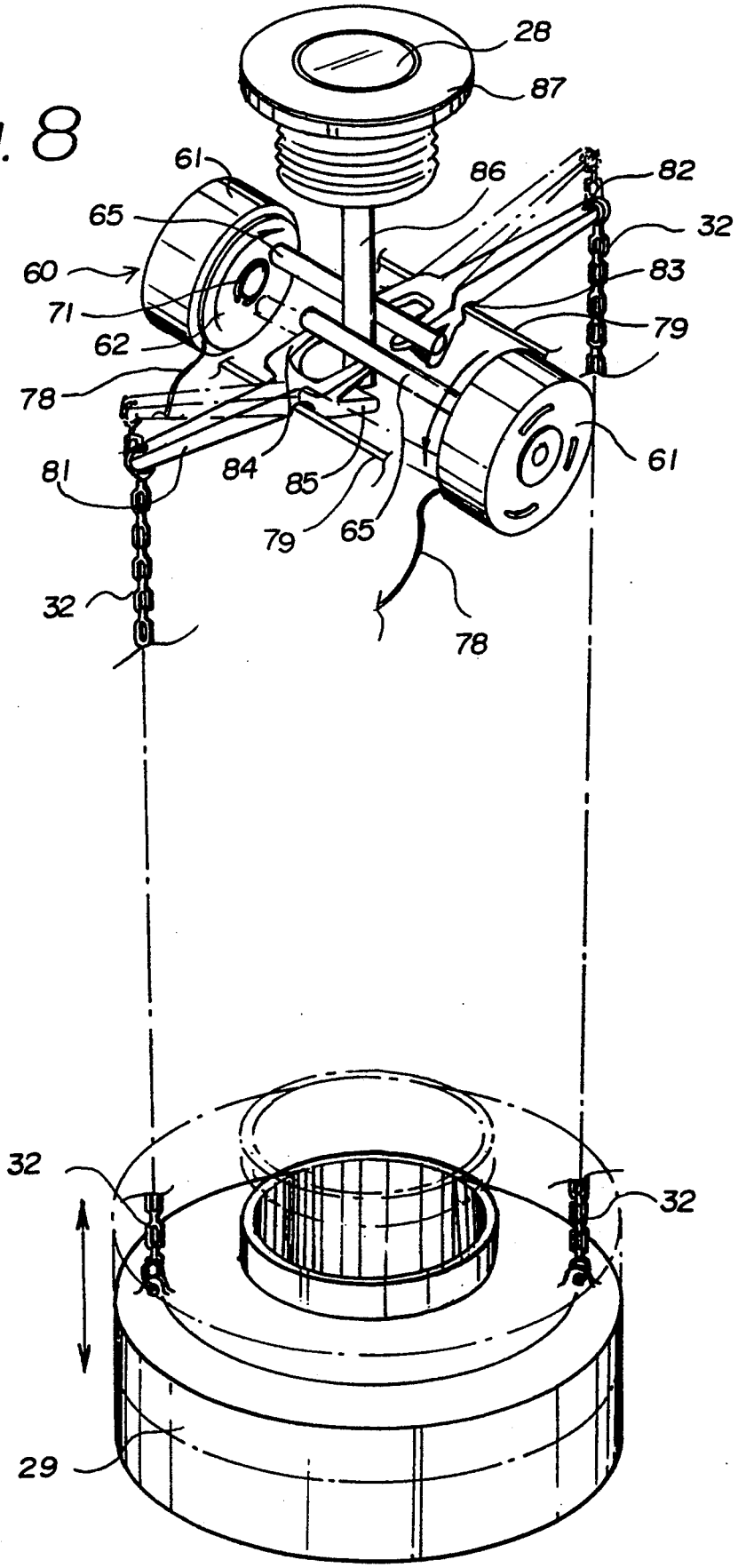
FIG. 8 is a perspective view of an automatic or manual flushing system according to the present invention.

As shown in FIGS. 5 and 8, the solenoid member 60 includes a pair of returnable solenoids 61. Each returnable solenoid 61 has an electric wire 78 attached to an armature plate 62 with an armature hub 63 and a stainless shaft 64, a solenoid lever 65 attached to the armature plate 62, a bronze sleeve bearing 66, a case 67 with stainless steel balls 68, a precision coil 69, and a base 70 with a retainer ring 71 (Lucas Ledex, Solenoid Design Guide, 1991). The returnable solenoid 61 is disposed in a solenoid housing 104 with a plurality of bolts 105 (FIG. 3). The pair of returnable solenoids 61 are connected to an electric source (not shown) with DC 12 volts.

As shown in FIG. 8, the solenoid member 60 is provided with a pair of Y-shaped pivot levers 81. Each pivot lever 81 contains a chain aperture 82 for attaching the chain 32, a pivot aperture 83 pivotally connected to a pivot lever support 79, a pair of Y-shaped upper wings 84 actuable by the solenoid lever 65, and a lower wing 85 actuable by a push button support 86 disposed in a push button container 87.

Accordingly, when the pair of solenoids 61 is activated through the electric wires 78, the pair of armature plates 62 rotate in the direction, respectively, indicated by arrows shown in FIG. 8. Therefore, the pair of solenoid levers 65 push the pair of upper wings 84 of pivot levers 81. The chain apertures 82 move up and also, the flapper valve 29 moves up so that the toilet assembly is flushed. Also, when the user pushes the manual flush push button 28, if necessary, the push button support 86 pushes the pair of lower wings 85 of the Y-shaped pibot levers 81. Therefore, the toilet assembly is flushed as described above.

As shown in FIGS. 3 and 4, the flapper valve 29 is upwardly and downwardly connected to a rubber packing 92 disposed on a flapper tube 91. The flapper tube has a threaded bolt 93 threadably attached to a threaded nut 94 through a rubber washer 95 (FIG. 4). The flapper tube 29 further has a plurality of inner vertical channels 96 for tightly receiving a plurality of legs 97 extended from the vertical main tube 33. The vertical main tube 33 is provided with a plurality of vertical slits 111 for allowing movement of a movable ball valve 98 along the interior of the vertical slits 111.

The movable ball valve 98 is stopped by a stopper 99 disposed at the interior surface of the vertical slits 111 of the main tube 33. Also, the flapper valve 29 has an inclined inlet 100 easily closed and opened by the flapper valve 29.

As shown in FIGS. 3 and 4, the L-shaped upward tube 30 is provided with a ball seat 101 disposed at the top thereof and a net ball cap 102 extending from the ball seat 101 for housing a water overflow ball valve 103 between the ball seat 101 and the net ball cap 102 so as to allow a discharge of overflowing flush water 21 from the toilet water holding tank 11 thereto by floating the water overflow ball valve 101 as described in U.S. Pat. No. 5,005,222 issued by the present inventor. The water hose 27*a* is connected to the upper portion of the L-shaped upward tube 30 for allowing the fresh flush water 21 to be passed into the L-shaped upward tube 30.

The motion sensor member 13 is disposed on the front exterior of the toilet water holding tank 11 in the middle portion of the front exterior thereof in alignment with the sensor aperture 18 of the toilet seat cover 17 (FIG. 1).

As shown in FIG. 2, the motion sensor member 13 includes a sensor box 88 containing the motion sensor 89 connected to the electrical wire 78 and an indicator light 90.

Also, the motion sensor 89 is not an on/off type switch or relay type switch so that the motion sensor member 13 is durable when compared with the switch of the conventional vented toilet assemblies.

Furthermore, since the toilet seat cover 17 disposed over the seat ring 16 has the sensor aperture 18, the motion sensor 89 is free of interference from the opening and closing of the toilet seat cover 17 (FIG. 1). The motion sensor 89 is connected to the electrical source (not shown) through the electrical wires 78, with DC 12 volts.

Also, the motion sensor 89 actuates for allowing the fan motor 45 to be operated while the user sits on the seat ring 16 upon opening the toilet seat cover 17 and in turn the motion sensor 89 deactivates when the user stands up. On the other hand, if the user is apart from the predetermined area from the motion sensor 89, the motion sensor 89 deactivates. The predetermined area is about 1.5 feet from the motion sensor 89.

According to the present invention, the toilet assembly operates as follows. First of all, upon opening the toilet seat cover 17, while the user sits on the seat ring 16, the motion sensor 89 activates for allowing the electromagnet 37 to be actuated and simultaneously the electromagnet 37 pulls the connecting plate 38 up. Therefore, the odor air valve plate 41 is open (FIG. 6B) by pushing the odor air valve 42 through both ends of the inwardly hooked lever 40 in the direction indicated as shown in dotted lines from real lines of FIG. 4. At this time, the trap way valve 54 continuously maintains an open state (FIG. 7A) because the water 21 is not supplied from the second water hose 27*b* from the toilet water holding tank 10.

Accordingly, the objectionable odor is evacuated from the toilet bowl 14 through a plurality of openings 107 in the direction indicated by real lines arrows shown in FIG. 2, and the main tunnel 15 is ventilated into the vertical main tube 33 and is ventilated into the trap way through the pocket 34, the air tube 48, and the trap way valve member 50, and discharged to the siphon passage 19 and then the objectionable odor is directly discharged to the sewer line 20 (FIG. 2). Also, at that time, since the flapper valve 29 continuously maintains a closed state, the flush water 21 does not interfere so that the objectionable odor is effectively ventilated.

However, the motion sensor 89 only maintains an on-position for the ventilation for about 30 minutes. Because the human being usually sits on the toilet less than 30 minutes and even though sometimes the towels can be put on the motion sensor 89, the ventilation system operates for only 30 minutes. In turn, when the user stands up and is apart from the toilet assembly such as 1.5 feet, the motion sensor 89 is in an off-position for ventilation so that the electromagnet 37 deactivates and the contacting plate 38 moves down to tightly close the odor air valve plate 41 against the rubber gasket top opening 110. Simultaneously, the motion sensor 89 is in an on-position for flushing so that the solenoid member 60 actuates. Therefore, the pair of solenoid levers 65 push the pair of upper wings 84 by rotation of the armature plates 62 as indicated by arrows shown in FIG. 8. The flapper valve 29 is open and the fresh flush water 21 flows to the toilet bowl 19 from the toilet water holding tank 10 through the plurality of openings 107 in the direction indicated by dotted lines arrows shown in FIG. 2.

At this time, the movable ball valve 98 moves up to the stopper 99 along the inside walls of the plurality of legs 97 due to the water pressure to close the lower portion of the vertical main tube 33. Also, the electromagnet 37 is deactivated by the off-position of the motion sensor for ventilation and the odor air valve plate 41 is in a closed state (FIG. 6A). Therefore, the flush water effectively discharges the waste product and associated objectionable odor directly to the sewer discharge line 20 through the siphon passage 19.

Also, at this time, the fresh water 21 flows to the second water hose 27*b* and to the piston cylinder 59 through the water aperture 108. Therefore, the piston 57 moves up and the pentahedron head 58 pushes the pivotal lever 55 so that the trap way valve plate 54 is in a closed state (FIG. 7B). Accordingly, the toilet assembly of the present invention becomes a siphon type. If a power failure occurs, the user simply pushes the manual flush push button 28. Therefore, the push button support 86 pushes the pair of lower wings 85 whereby the flapper valve 29 moves up by pulling of the pair of chains 32.

Thus, the toilet assembly of the present invention is simple in construction, compact for portability, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toilet assembly having a combined ventilation and flushing system, said toilet assembly comprising:

a toilet stool including a toilet bowl, a water flush guiding pipe communicating with said bowl for allowing flush water to be flushed into the toilet bowl, a seat ring disposed on said bowl, a toilet seat cover disposed on the peripheral top of said seat ring, a sensor aperture disposed on said toilet seat cover and a siphon passage disposed in said toilet bowl for discharging waste products and associated objectionable odor directly from the toilet bowl to a sewer discharge line;

a toilet water holding tank containing flush water, said toilet water holding tank having a water intake valve, a flapper valve, a flapper tube having a plurality of vertical channels disposed on the interior thereof, a float ball, a first water hose, and a second water hose;

a multifunctional tube disposed in said toilet water holding tank, said multifunctional tube communicating with said toilet bowl and said flapper valve at one end, and connected to said siphon passage at another end thereof, said multifunctional passage including:

a vertical main tube having a circumferential raised portion disposed on an interior surface thereof, a plurality of vertical slits disposed on a wall thereof, and a plurality of legs insertable into said plurality of vertical channels of said flapper tube, an odor air valve member disposed in an upper portion of said vertical main tube, said odor air valve member containing an electromagnet, a lever having two inwardly hooked ends, an air valve plate, and an air valve handle, a pocket extending from a side wall of the upper portion of said vertical main tube and communicating with said opening of said vertical main tube, a fan motor disposed in said pocket, and an L-shaped downward tube extending from said pocket;

a solenoid member disposed on the top of said multifunctional tube, said solenoid member including:

a pair of returnable solenoids having a solenoid pivot lever attached to an armature plate thereof, respectively, a pair of Y-shaped solenoid levers having a pair of chains attached to both outside ends thereof for connecting to said flapper valve, and a pair of Y-shaped upper wings for contacting said solenoids and a lower wing, respectively whereby when said pair of returnable solenoids are actuated by the electric source, said pair of solenoid levers push said pair of Y-shaped upper wings so as to lift said flapper valve for automatically flushing the toilet assembly;

a manual push button supported on the top of said multifunctional tube, said manual push button having a push button support whereby when the user pushes said push button, said push button support pushes said both lower wings so as to lift said flapper valve for manually flushing the toilet assembly;

a trap way valve member connected to said L-shaped downward tube at a top opening thereof and to an air tube and a trap way connected to said siphon passage at a side wall opening thereof, said trap way valve including:

a piston having a piston shaft and a piston head, both disposed in a piston housing, a water hole disposed on the side wall of the lower portion of said piston housing and connected to said second water hose, a trap way valve having a valve lever operatively supported by said piston head whereby said trap way valve is opened or closed by the water pressure of the second water hose, said second water hose having an air aperture disposed on the upper portion thereof and located over the water surface of the toilet water holding tank, a movable ball valve disposed to move between a first position adjacent said flapper valve to a second position in a lower portion of said vertical main tube for allowing exhaust gas to flow from the bowl to the siphon passage in said first position or flush water to flow from the toilet water holding tank via said legs to the toilet bowl in said second position, and a motion sensor disposed on the front exterior of said toilet water holding tank, said motion sensor being operable independently of the opening and closing of the toilet seat cover due to said sensor aperture of the toilet seat cover, whereby with the toilet seat cover open, while the user sits on the seat ring, the motion sensor actuates for ventilation and allowing the electromagnet to be operated so that the contacting plate moves upwardly to the electromagnet, both ends of the inwardly hooked lever push the odor air valve handle and the odor air valve handle is open, and simultaneously the fan motor and fan operate for ventilating the objectionable odor through the opened trap way valve to the sewer discharge line through the trap way and siphon passage, and in turn when the user stands up, the motion sensor actuates for flushing and allowing the pair of returnable solenoids to be operated so that the flapper valve moves upwardly through the pair of solenoid pivot levers and the pair of chains, and simultaneously the piston moves up by the water pressure of the second water hose for allowing the trap way valve to be closed so that the flush water discharges the waste products and associated objectionable odor directly to the sewer discharge line through the trap way and siphon passage.

2. The toilet assembly of claim 1, wherein said air valve plate has a trihedron attached on the central upper surface thereof for tightly closing the air valve to a rubber gasket top opening of the vertical main tube.

3. The toilet assembly of claim 2, wherein said air valve member is provided with a valve rod located between said air valve plate and said air valve handle as a hinge, said valve rod being disposed in a pair of rod seats wherein said rod seats have a groove, respectively, for slidably allowing movement of the valve rod up and down therein according to the closing and opening of the air valve, respectively.

4. The toilet assembly of claim 1, wherein said inwardly hooked lever is attached to a pivot pin at the top end thereof for allowing the bottom end of the hooked lever to push the valve handle upon actuation of the electromagnet.

5. The toilet assembly of claim 1, wherein said piston head has a pentahedron for allowing the valve lever to be selectively pushed by facing a vertical face or a slope face thereof so as to close or open the trap way valve.

6. The toilet assembly of claim 5, wherein said slope face has an angle of over 45° so that the side wall opening can be fully opened.

7. The toilet assembly of claim 1, wherein said air tube and trap way have a corrugated configuration, respectively.

8. The toilet assembly of claim 7, wherein said air tube identifies a first air tube and a second air tube through a pair of rubber packings.

9. The toilet assembly of claim 7, wherein said trap way is directly connected with said siphon passage of the toilet assembly.

10. The toilet assembly of claim 1, wherein said pair of returnable solenoids are connected to the electric source with DC 12 volts.

11. The toilet assembly of claim 1, wherein said solenoid pivot lever is provided with a pivot lever support for pivotally connecting the solenoid pivot lever to the pivot lever support.

12. The toilet assembly of claim 1, wherein said motion sensor is provided with a sensor box and an indicator light, whereby the sensor box containing the motion sensor can easily be attached to the front exterior of the toilet water holding tank and is connected to the electric source with DC 12 volts.

13. The toilet assembly of claim 12, wherein said motion sensor is inoperative when the user is apart from the predetermined area therefrom.

14. The toilet assembly of claim 13, wherein the predetermined area is about 1.5 feet from said motion sensor.

15. The toilet assembly of claim 12, wherein the motion sensor deactivates automatically after the motion sensor operates for about 30 minutes.

16. The toilet assembly of claim 1, wherein said vertical main tube is provided with an L-shaped upward tube connected to the lower portion thereof, said L-shaped upward tube including a ball seat disposed at the top portion thereof for containing a water overflow ball valve so as to discharge overflowing flush water from the toilet water holding tank to the toilet stool.

17. The toilet assembly of claim 16, wherein said ball seat is provided with a net ball cap supported by said ball seat for allowing movement of said water overflow controlling ball valve between the net ball cap and the ball seat.

18. The toilet assembly of claim 1, wherein said movable ball valve can be stopped at said circumferential raised portion of said vertical main tube.

* * * * *